US010689888B2

(12) United States Patent
Kaino

(10) Patent No.: US 10,689,888 B2
(45) Date of Patent: Jun. 23, 2020

(54) OPENING AND CLOSING BODY CONTROL APPARATUS FOR VEHICLE

(71) Applicant: AISIN SEIKI KABUSHIKI KAISHA, Kariya-shi (JP)

(72) Inventor: Takashi Kaino, Anjo (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 421 days.

(21) Appl. No.: 15/670,079

(22) Filed: Aug. 7, 2017

(65) Prior Publication Data

US 2018/0087296 A1 Mar. 29, 2018

(30) Foreign Application Priority Data

Sep. 23, 2016 (JP) ..... 2016-186100

(51) Int. Cl.
*E05B 81/56* (2014.01)
*E05B 83/40* (2014.01)
(Continued)

(52) U.S. Cl.
CPC ..... *E05B 81/56* (2013.01); *E05B 81/20* (2013.01); *E05B 81/58* (2013.01); *E05B 81/64* (2013.01);
(Continued)

(58) Field of Classification Search
CPC . Y10T 292/699; Y10T 70/5889; Y10T 70/70; E05B 81/06; E05B 81/64; E05B 81/54; E05B 81/56; E05Y 2400/30
See application file for complete search history.

(56) References Cited

U.S. PATENT DOCUMENTS 6,276,743 B1 * 8/2001 Jyawook ..... B60J 5/06 296/155
6,685,239 B2 2/2004 Yamauchi et al.
(Continued)

FOREIGN PATENT DOCUMENTS

JP 2002-250162 9/2002
JP 3666732 6/2005

OTHER PUBLICATIONS

U.S. Appl. No. 15/670,095, filed Aug. 7, 2017, US 2018-0087297 A1, Takashi Kaino.

*Primary Examiner* — Mark A Williams
(74) *Attorney, Agent, or Firm* — Oblon, McClelland, Maier & Neustadt, L.L.P.

(57) ABSTRACT

An opening and closing body control apparatus for a vehicle includes: a lock device that has a latch mechanism; and a control device that controls an operation of the lock device. The lock device has a rotation member rotating in first and second directions, and the latch mechanism performs close and release operations according to a rotating direction of the rotation member. The control device executes a close control for rotating the rotation member from a neutral position to a first position in the first direction to cause the latch mechanism to perform the close operation. The control device includes a neutral return control portion. The neutral return control portion includes a counter, a neutral return determination portion, and a count holding portion. In a case where the neutral return control is restarted, the count-up of the counter is restarted from the count value at the time of interruption.

6 Claims, 12 Drawing Sheets

(51) Int. Cl.

| | |
|---|---|
| ***E05B 81/58*** | (2014.01) |
| ***E05B 81/20*** | (2014.01) |
| ***E05B 81/64*** | (2014.01) |
| *E05B 81/06* | (2014.01) |
| *E05B 81/36* | (2014.01) |

(52) U.S. Cl.
CPC ..... *E05B 83/40* (2013.01); *E05B 81/06* (2013.01); *E05B 81/36* (2013.01)

(56) References Cited

U.S. PATENT DOCUMENTS

| | | | | |
|---|---|---|---|---|
| 8,967,680 | B2 * | 3/2015 | Yokomori | B60J 5/00 292/201 |
| 9,290,969 | B2 * | 3/2016 | Yokota | E05B 81/20 |
| 10,472,866 | B2 * | 11/2019 | Kaino | E05B 83/40 |
| 2009/0199605 | A1 * | 8/2009 | Spurr | E05B 81/14 70/266 |
| 2011/0148575 | A1 * | 6/2011 | Sobecki | E05B 85/103 340/5.64 |
| 2016/0010365 | A1 * | 1/2016 | Hanaki | E05B 81/14 292/21 |
| 2016/0237733 | A1 * | 8/2016 | Henseleit | B60J 5/047 |
| 2016/0251877 | A1 * | 9/2016 | Reddmann | E05B 77/28 292/200 |
| 2016/0319933 | A1 * | 11/2016 | Adams | F16H 63/3491 |
| 2017/0138096 | A1 * | 5/2017 | Zhang | E05B 77/38 |
| 2017/0204639 | A1 * | 7/2017 | Akahori | E05B 85/02 |
| 2019/0271179 | A1 * | 9/2019 | Patane | E05B 81/16 |

* cited by examiner

UNLATCHED STATE

WHEN STRIKER ENTERS

HALF LATCH STATE

WHEN CLOSE OPERATION IS PERFORMED

FULL LATCH STATE

WHEN RELEASE OPERATION IS PERFORMED

NORMAL (P0: NEUTRAL POSITION)

WHEN CLOSE OPERATION IS PERFORMED (FIRST POSITION P1)

WHEN RELEASE OPERATION IS PERFORMED (SECOND POSITION P2)

OPENING AND CLOSING BODY CONTROL APPARATUS FOR VEHICLE

CROSS REFERENCE TO RELATED APPLICATIONS

This application is based on and claims priority under 35 U.S.C. § 119 to Japanese Patent Application 2016-186100, filed on Sep. 23, 2016, the entire contents of which are incorporated herein by reference.

TECHNICAL FIELD

This disclosure relates to an opening and closing body control apparatus for a vehicle.

BACKGROUND DISCUSSION

In the related art, in an opening and closing body control apparatus for a vehicle having a drive source and moving an opening and closing body of a vehicle, for example, as in a slide door control device disclosed in Japanese Patent No. 3666732 (Reference 1), a drive control of the slide door that is an opening and closing body is stopped when a power source voltage is lowered. After restoring the lowered power source voltage, the drive control before the stop is restarted.

That is, in a vehicle having a vehicle-mounted power source with a limited capacity, for example, the power source voltage is temporarily lowered due to start of cranking of an engine or the like. In such a state, in a case where the drive control of the slide door is executed, the supply of drive power is unstable. Therefore, there is a problem that a smooth opening and closing operation of the slide door cannot be guaranteed.

However, occurrence of such a problem can be prevented by adopting the configuration of the related art described above. After restoring the power source voltage, the opening and closing operation of the slide door is automatically restarted so that convenience can be improved.

In addition, normally, a lock device including a latch mechanism is provided in the opening and closing body of a vehicle. For example, as disclosed in JP 2002-250162A (Reference 2), such a lock device has a rotation member that rotates in a first direction and a second direction. That is, such a lock device is configured such that, for example, when the rotation member rotates from a neutral position in the first direction, the latch mechanism performs a close operation and when the rotation member rotates from the neutral position in the second direction, the latch mechanism performs a release operation. After the close control and the release control are completed, a neutral return control for causing the rotation member to rotate so as to return the rotation member to the neutral position is executed.

However, in the configuration in which the close operation and the release operation are switched according to the rotating direction of the rotation member, there is a concern that the rotation member cannot be returned to the neutral position after restart of the neutral return control by interrupting the neutral return control. In such a case, since the lock device may not function correctly, in this respect, there is still room for improvement.

Thus, a need exists for an opening and closing body control apparatus for a vehicle which is not susceptible to the drawback mentioned above.

SUMMARY

It is preferable that an opening and closing body control apparatus for a vehicle according to an aspect of this disclosure includes a lock device that has a latch mechanism; and a control device that controls an operation of the lock device, in which the lock device has a rotation member rotating in a first direction and a second direction, and the latch mechanism performs a close operation and a release operation according to a rotating direction of the rotation member, the control device executes a close control for rotating the rotation member from a neutral position to a first position in the first direction in order to cause the latch mechanism to perform the close operation, the control device includes a neutral return control portion rotating the rotation member so as to return the rotation member to the neutral position after completion of the close control, the neutral return control portion includes a counter that counts up by continuing the neutral return control for returning the rotation member to the neutral position, a neutral return determination portion that determines whether the rotation member returns to the neutral position, based on a count value of the counter, and a count holding portion that holds the count value at the time of interruption in a case where the neutral return control is interrupted, and in a case where the neutral return control is restarted, the count-up of the counter is restarted from the count value at the time of interruption.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment of an opening and closing body control apparatus for a vehicle embodied in a power slide door apparatus will be described with reference to the drawings.

Figure 1:
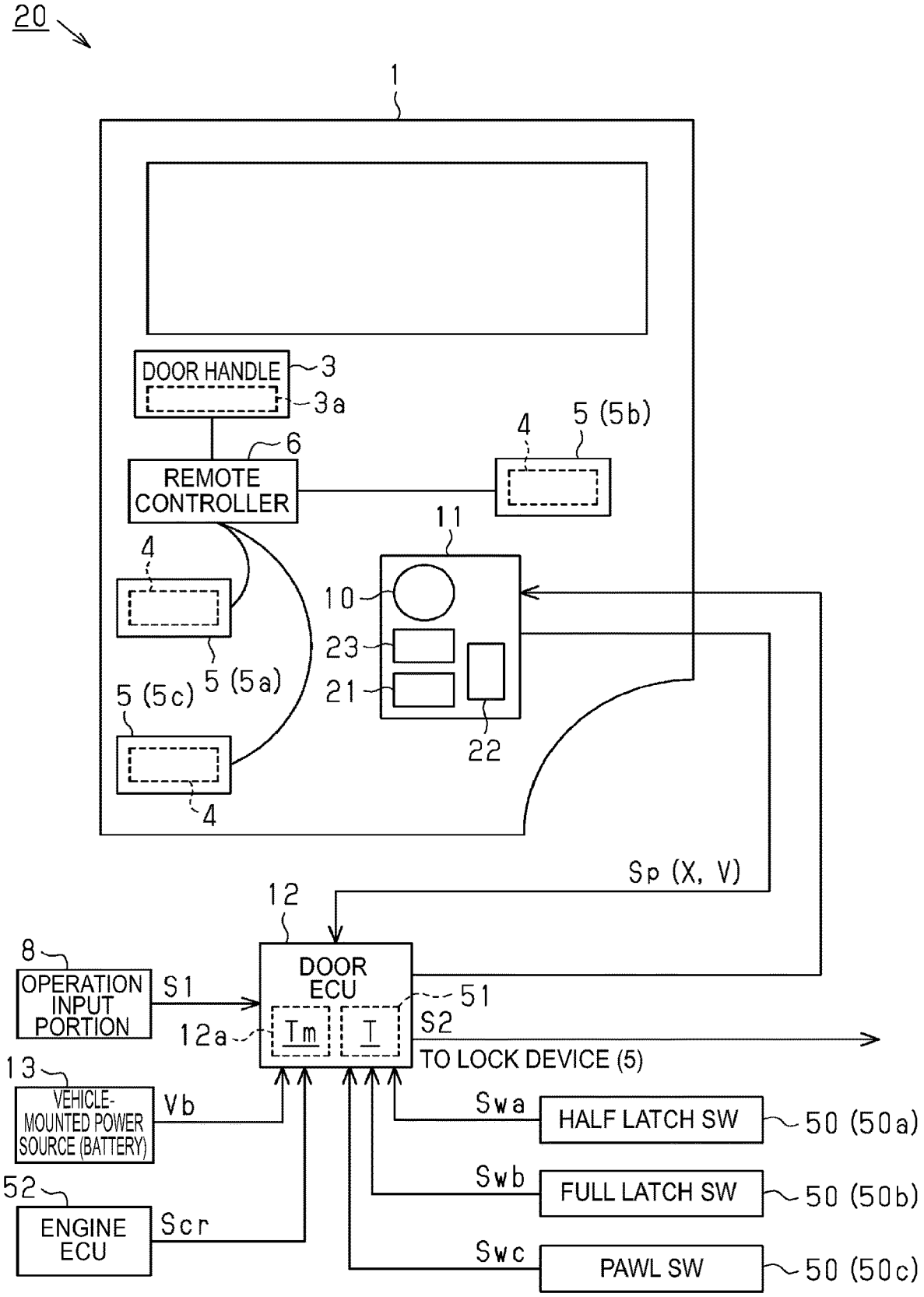
FIG. 1 is a schematic diagram of a configuration of a power slide door apparatus.

As illustrated in FIG. 1, a slide door 1 is supported on a side surface of a vehicle (not illustrated) and moves in a forward and rearward direction to open and close a door opening portion provided on the side surface of the vehicle. Specifically, the slide door 1 is configured so as to be in a full closed state in which the door opening portion is closed by being moved to a vehicle front side (left side in the same drawing), and in a full opened state in which an occupant can get on or off a vehicle via the door opening portion by being moved to a vehicle rear side (right side in the same drawing). The slide door 1 is provided with a door handle 3 for opening and closing the slide door 1.

In addition, the slide door 1 is provided with a plurality of lock devices 5 having latch mechanisms 4 engaging with strikers (not illustrated) provided on a vehicle side according to a moving position of the slide door 1. Specifically, the slide door 1 is provided with a front lock 5*a* and a rear lock 5*b* as full closed locks which hold the slide door 1 at a full closed position. Furthermore, the slide door 1 is provided with a full open lock 5*c* for holding the slide door 1 at a full opened position. The lock devices 5 are connected to the door handle 3 via a remote controller 6.

That is, the slide door 1 of the embodiment is configured such that an engagement state of the latch mechanism 4 configuring each of the lock devices 5 is released by operating operation portions (outer handle and inner handle) 3*a* of the door handle 3. With the door handle 3 as a gripping portion, it is possible to manually open and close the door.

In addition, the slide door 1 of the embodiment is configured such that the engagement state of the latch mechanism 4 configuring the lock device 5 is capable of being released also by operating an operation switch provided in a passenger compartment or an operation input portion 8 of a portable device by an occupant. Furthermore, the slide door 1 of the embodiment is provided with a door actuator 11 of which a drive source is a motor 10 and a door ECU 12 that controls an operation of the door actuator 11 through a supply of a drive power to the motor 10. That is, the door ECU 12 of the embodiment generates the drive power supplied to the motor 10 of the door actuator 11 based on a power source voltage Vb of a vehicle-mounted power source (battery) 13. Therefore, in the vehicle of the embodiment, a power slide door apparatus 20 capable of causing the slide door 1 to perform an opening and closing operation based on the driving force of the motor 10 is formed.

More specifically, an operation input signal S1 indicating that the operation input portion 8 provided in the door handle 3, the passenger compartment, the portable device, or the like is operated is input into the door ECU 12 of the embodiment. That is, the door ECU 12 of the embodiment detects an opening and closing operation request of the slide door 1 by a user based on the operation input signal S1. The operation of the door actuator 11 is controlled so as to move the slide door 1 in a requested opening and closing operation direction.

More specifically, the door actuator 11 of the embodiment includes an opening and closing drive portion 21 able to drive the opening and closing of the slide door 1 via a drive cable (not illustrated) by being rotated based on the driving force of the motor 10. In addition, the door actuator 11 is provided with a pulse sensor 22 outputting a pulse signal Sp in synchronization with the operation of the opening and closing drive portion 21. The door ECU 12 of the embodiment is configured to control the operation of the door actuator 11 based on a moving position X and a moving speed V of the slide door 1 detected by counting the pulse signal Sp, or the like.

In addition, the door actuator 11 of the embodiment is provided with an electromagnetic clutch 23 capable of connecting and disconnecting a torque transmission path between the motor 10 and the opening and closing drive portion 21. For example, the electromagnetic clutch 23 is controlled so as to cut the torque transmission path in a case where the slide door 1 is manually opened and closed. Therefore, the power slide door apparatus 20 of the embodiment is configured such that the slide door 1 smoothly performs the opening and closing operation even during the manual operation.

Furthermore, the door ECU 12 of the embodiment controls the operation of each of the lock devices 5 through an output of a lock control signal S2. Specifically, in a case where the slide door 1 at the full opened position or the full closed position performs the opening and closing operation, before the drive control of the slide door 1 is started, in order to release the latch mechanism 4 in the engagement state, the operation of the lock device 5 is controlled (release control). In a case where the latch mechanism 4 of the lock device 5 is in a half latch state when executing the drive control in which the slide door 1 is moved to the full closed position, the operation of the lock device 5 is controlled so that the latch mechanism 4 is shifted to a full latch state (close control).

Lock Device

Next, the lock devices 5 provided in the power slide door apparatus 20 of the embodiment will be described.

Figure 2:
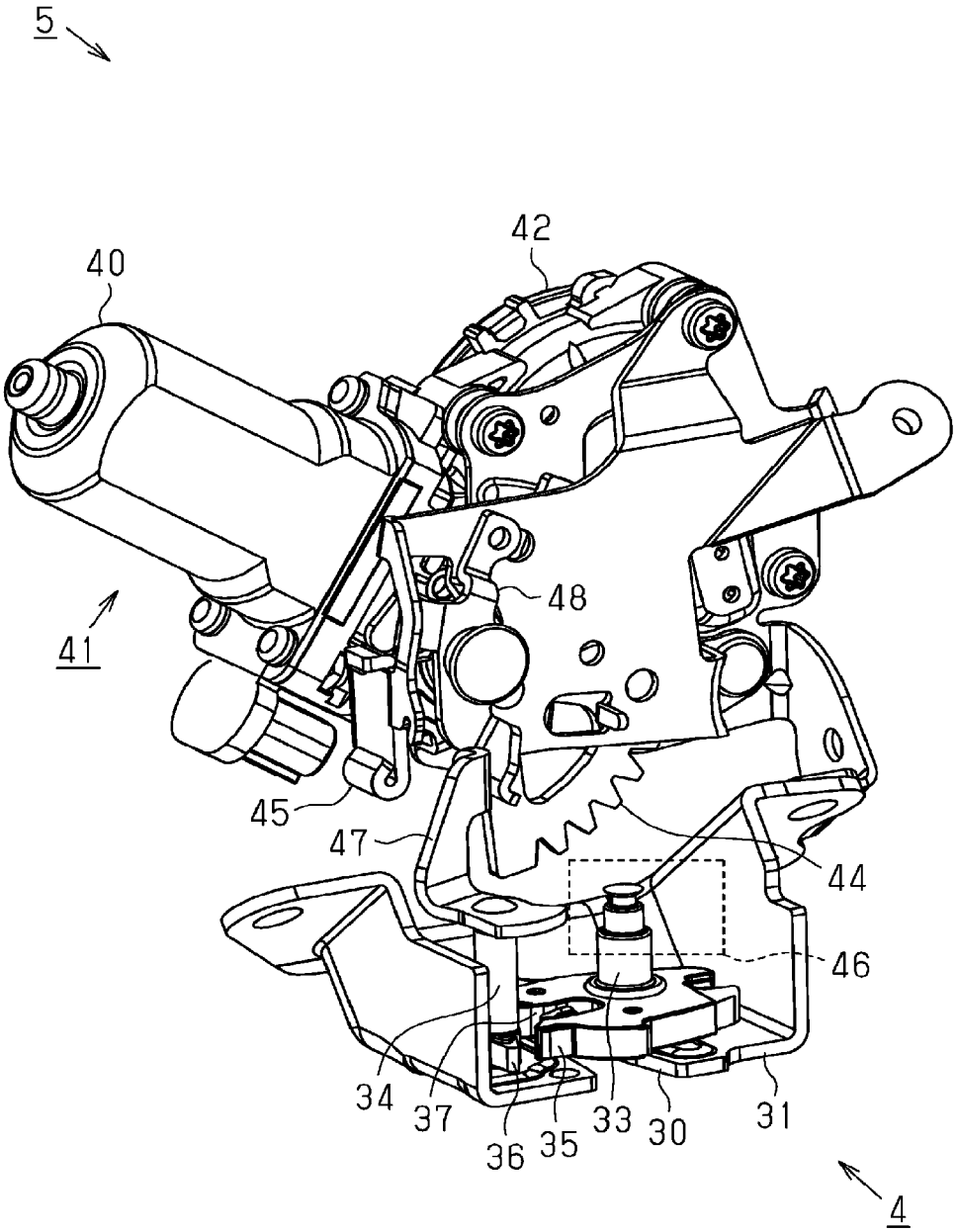
FIG. 2 is a perspective view illustrating a schematic configuration of a lock device.
Figure 3:
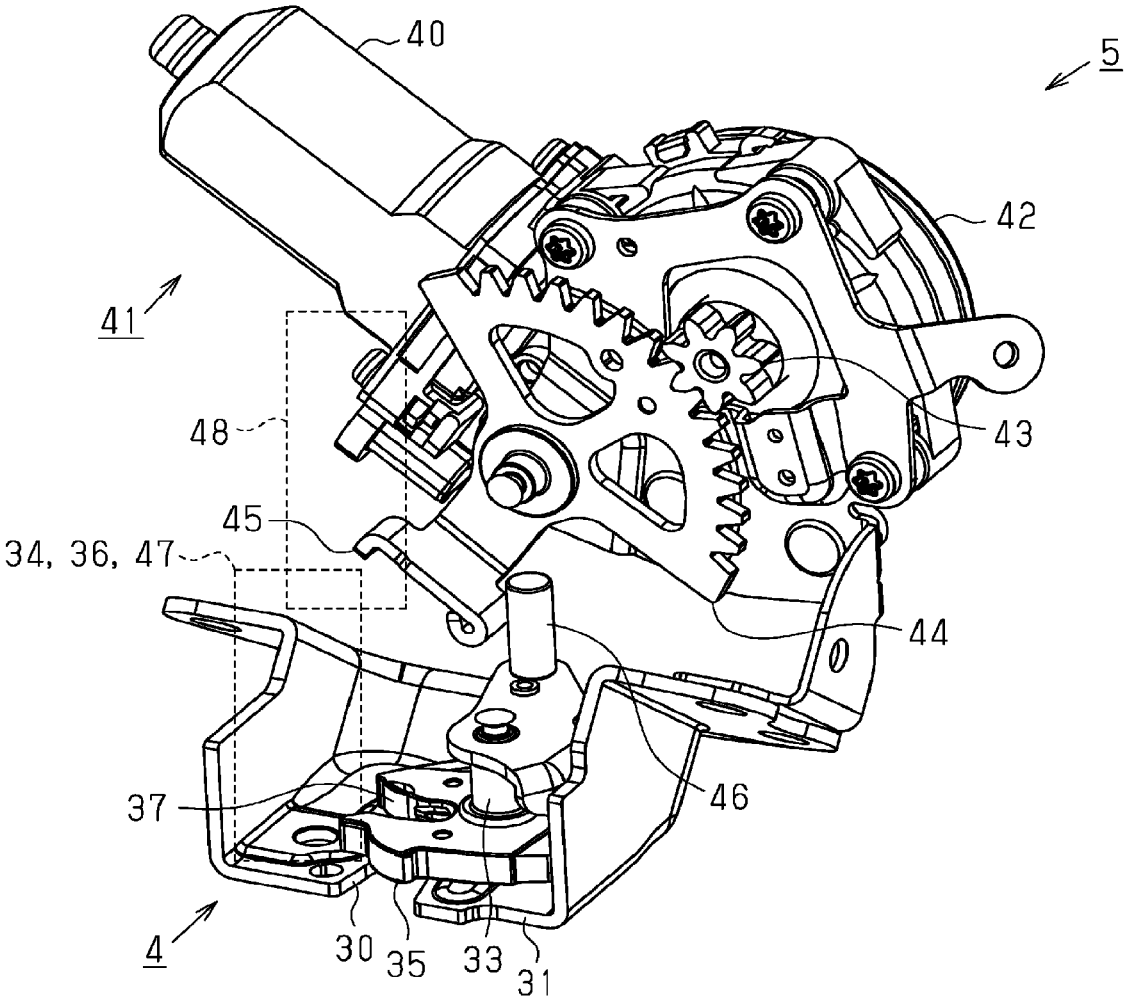
FIG. 3 is a perspective view illustrating a schematic configuration of the lock device.

As illustrated in FIGS. 2 and 3, the lock device 5 of the embodiment includes a base plate 31 having a slit-like striker inlet and outlet groove 30. In addition, on the base plate 31, two support shafts 33 and 34 are erected at positions with the striker inlet and outlet groove 30 being interposed therebetween in a groove width direction (rightward and leftward direction in each drawing). The latch mechanism 4 of the embodiment includes a latch 35 and a pawl 36 rotatably pivoted around the support shafts 33 and 34.

Figure 4:
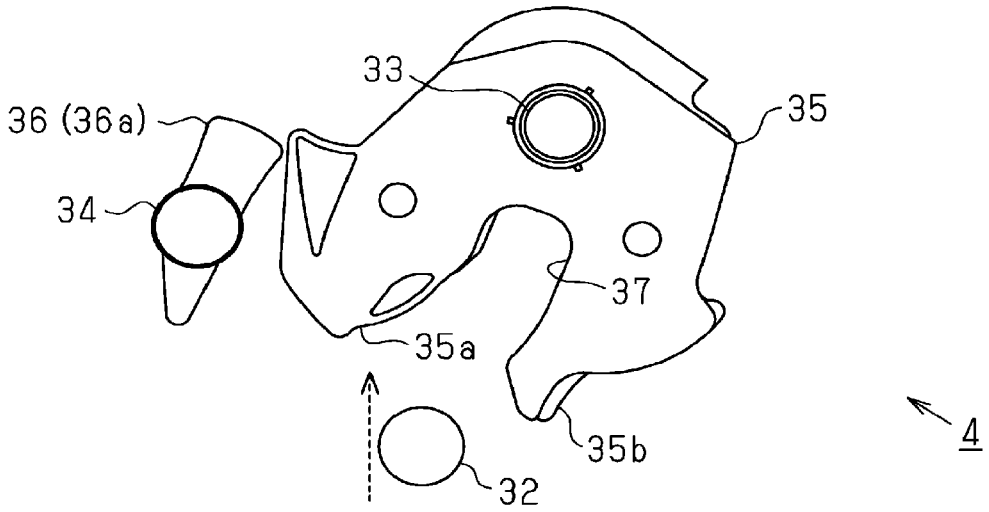
FIG. 4 is a view illustrating a schematic configuration and an operation of a latch mechanism (unlatch state)

As illustrated in FIG. 4, the latch 35 of the embodiment has a substantially flat plate-like outer shape having a striker engagement groove 37 opening on an outer peripheral surface thereof. In addition, the latch 35 is rotatably biased in the counterclockwise direction in FIG. 4 by a torsion coil spring (latch biasing spring) (not illustrated) fitted to the support shaft 33. Furthermore, the latch 35 abuts against a stopper portion (not illustrated) provided in the base plate 31 and thereby a rotation thereof is restricted based on a biasing force of the latch biasing spring at a position in which an opening end of the striker engagement groove 37 faces the striker inlet and outlet groove 30. Therefore, the latch mechanism 4 of the embodiment is configured such that a striker 32 entered the striker inlet and outlet groove 30 engages with the striker engagement groove 37 of the latch 35.

On the other hand, the pawl 36 of the embodiment is rotatably biased in the clockwise direction in FIG. 4 by a torsion coil spring (pawl biasing spring) (not illustrated) fitted to the support shaft 34. In addition, the pawl 36 is provided with an engagement portion 36*a* which moves in a direction approaching the outer peripheral surface of the latch 35 by a rotation based on a biasing force of the pawl biasing spring. Furthermore, the pawl 36 is configured such that the engagement portion 36*a* engages with the outer peripheral surface of the latch 35 in a state where the striker 32 engages with the striker engagement groove 37. Therefore, the latch mechanism 4 of the embodiment is capable of holding a state where the striker 32 engages with the striker engagement groove 37 of the latch 35.

Figure 5:
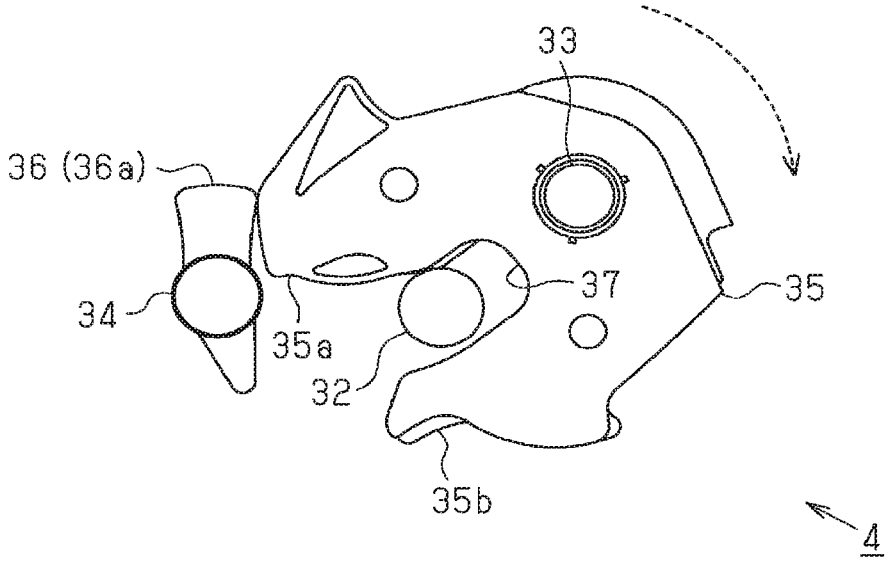
FIG. 5 is a view illustrating a schematic configuration and an operation of the latch mechanism (when a striker enters)
Figure 6:
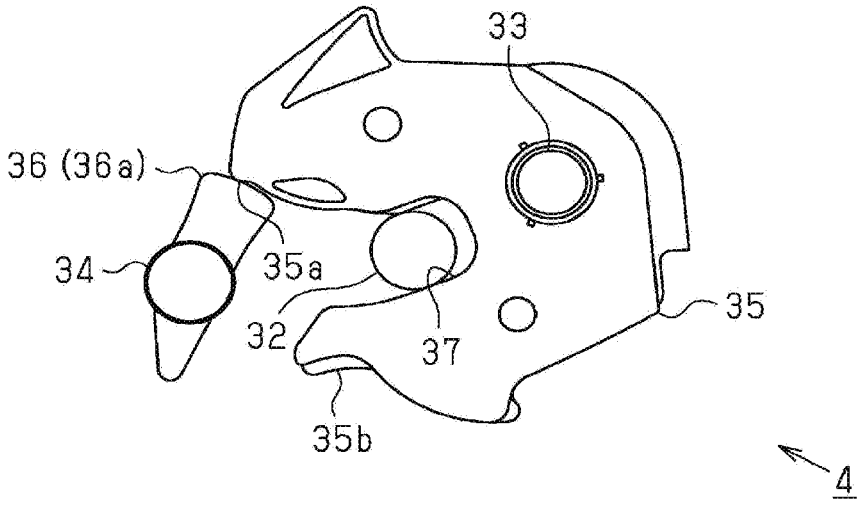
FIG. 6 is a view illustrating a schematic configuration and an operation of the latch mechanism (half latch state)

That is, as illustrated in FIGS. 5 and 6, the striker 32 entered the striker inlet and outlet groove 30 engages with the striker engagement groove 37 so as to relatively move inwardly (from a lower side to an upper side in each drawing) inside the striker inlet and outlet groove 30 while pressing the latch 35. Therefore, the latch 35 rotates in the clockwise direction in each drawing against the biasing force of the latch biasing spring.

In addition, in this case, the engagement portion 36*a* of the pawl 36 slides on the outer peripheral surface of the abutting latch 35 apparently in a state of being pressed against the outer peripheral surface of the latch 35 based on the biasing force of the pawl biasing spring. Therefore, the engagement portion 36*a* on the pawl 36 side engages with a first engagement portion 35*a* on the latch 35 side formed on the outer peripheral surface thereof so that the latch mechanism 4 of the embodiment is configured to restrict the rotation of the latch 35.

Specifically, in the embodiment, the first engagement portion 35*a* on the latch 35 side is set at an opening end of the striker engagement groove 37, specifically, on a side wall surface on a side being pressed by engaging with the striker 32. Therefore, the latch mechanism 4 of the embodiment is configured such that the striker 32 is held in the latch 35 in the engagement state by restricting the rotation thereof in the biasing direction by the latch biasing spring, that is, in a direction in which the striker 32 is discharged from the striker engagement groove 37 (half latch state).

In addition, as illustrated in FIGS. 2 and 3, the lock device 5 of the embodiment is provided with a lock actuator 41 of which a drive source is the motor 40. Specifically, the lock actuator 41 is configured as a so-called geared motor in which a motor 40 and a speed reducer 42 are integrally provided. Furthermore, the lock device 5 of the embodiment is operated by receiving the supply of the drive power based on the power source voltage Vb of the vehicle-mounted power source (battery) 13 from the door ECU 12. As described above, in a case where the latch mechanism 4 is in the half latch state (see FIG. 6), the lock actuator 41 is operated thereby shifting the latch mechanism 4 to the full latch state (close operation).

Figure 7:
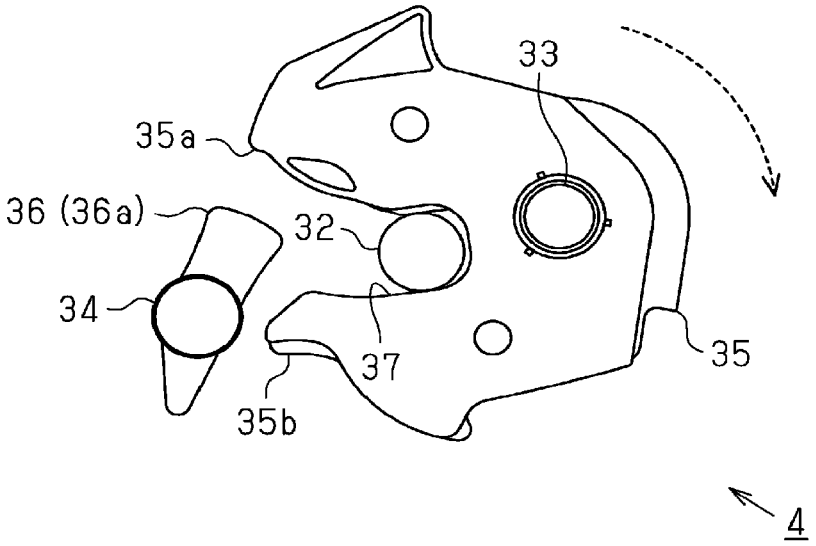
FIG. 7 is a view illustrating a schematic configuration and an operation of the latch mechanism (when a close operation is performed)
Figure 8:
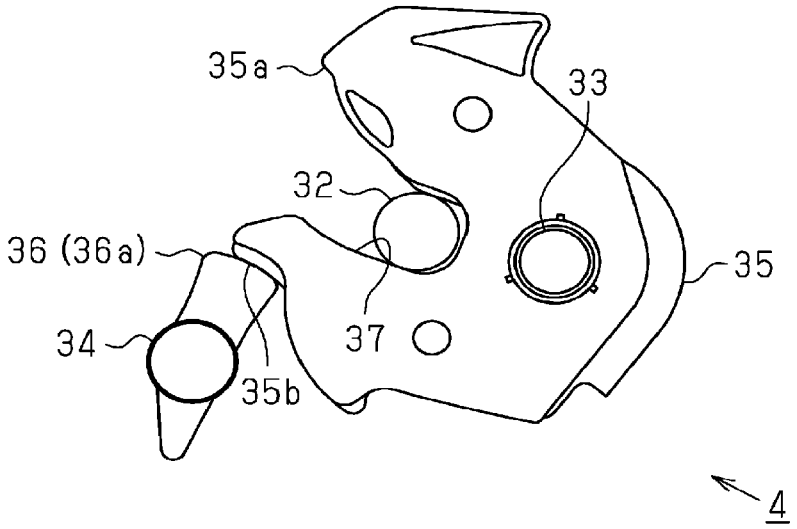
FIG. 8 is a view illustrating a schematic configuration and an operation of the latch mechanism (full latch state)

That is, as illustrated in FIGS. 6 to 8, the latch mechanism 4 of the embodiment is configured such that the latch 35 is rotated by driving the lock actuator 41 in a closing direction (clockwise direction in each drawing) against the biasing force of the latch biasing spring from a rotational position corresponding to the half latch state. In addition, the pawl 36 is configured so as to restrict the rotation of the latch 35 by engaging with a second engagement portion 35*b* formed on a peripheral surface of the latch 35 at a position at which the latch 35 is rotated in the closing direction based on the biasing force of the latch biasing spring. Therefore, the latch mechanism 4 of the embodiment is configured so as to be shifted to the full latch state in which the striker 32 engaging with the striker engagement groove 37 of the latch 35 is restrained to be relatively immovable.

Furthermore, the lock device 5 of the embodiment is configured such that the lock actuator 41 is operated thereby causing the latch mechanism 4 to perform the release operation, for example, based on an opening operation input to the operation input portion 8 or the like.

Figure 9:
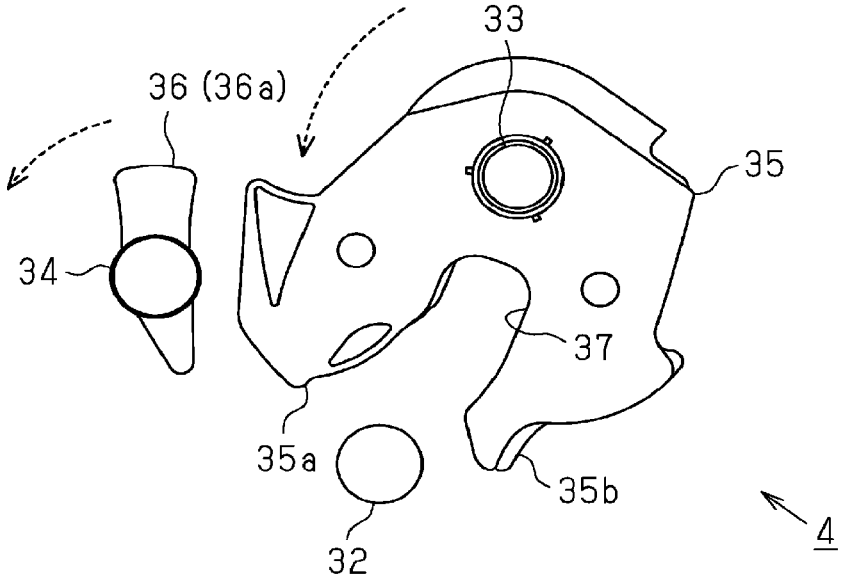
FIG. 9 is a view illustrating a schematic configuration and an operation of the latch mechanism (when a release operation is performed)

That is, as illustrated in FIGS. 8 and 9, the latch mechanism 4 of the embodiment is configured so that the pawl 36 is rotated in the counterclockwise direction in each drawing against the biasing force of the pawl biasing spring by being driven by the lock actuator 41. In addition, the rotation restriction by the engagement with the pawl 36 is released and thereby the latch 35 is rotated in a releasing direction (counterclockwise direction in each drawing) based on the biasing force of the latch biasing spring. Therefore, the latch mechanism 4 of the embodiment is configured such that the restriction of the striker 32 is released and the striker 32 is discharged from the striker engagement groove 37, thereby restoring to the unlock state as illustrated in FIG. 4.

More specifically, as illustrated in FIGS. 2 and 3, the lock actuator 41 of the embodiment outputs the rotation of the motor 40 decelerated by the speed reducer 42 with a pinion gear 43 as an output portion. In addition, the lock device 5 of the embodiment includes a sector gear 44 meshing with the pinion gear 43. Furthermore, the sector gear 44 is provided with an active lever 45 which integrally rotates with the sector gear 44. The lock device 5 of the embodiment is configured such that the latch mechanism 4 performs the close operation and the release operation according to the rotating direction of the active lever 45.

Figure 10:
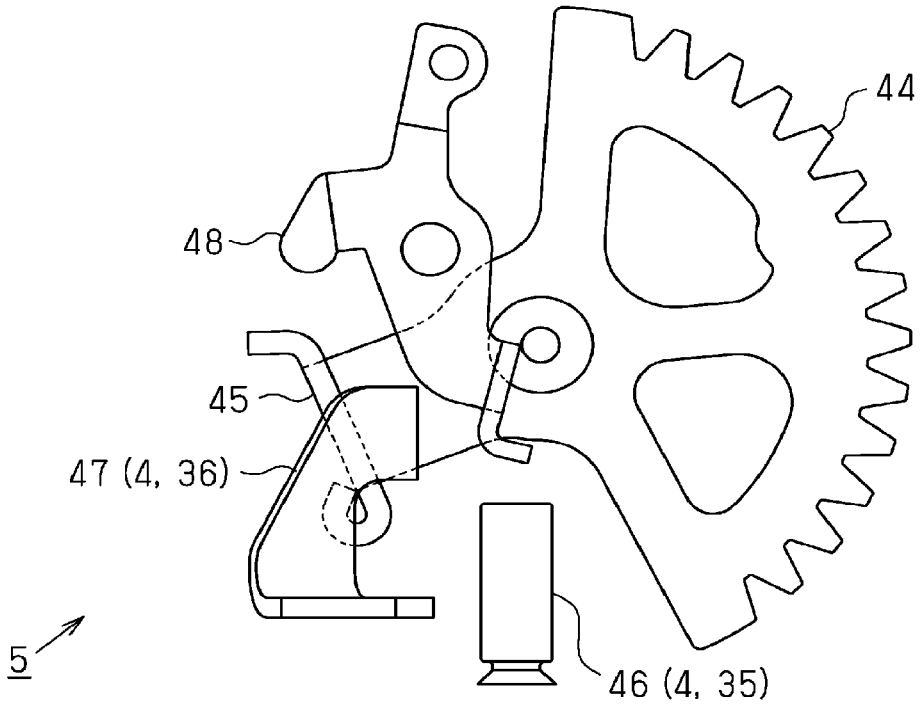
FIG. 10 is a view illustrating an operation of the lock device (normal: a neutral position)
Figure 11:
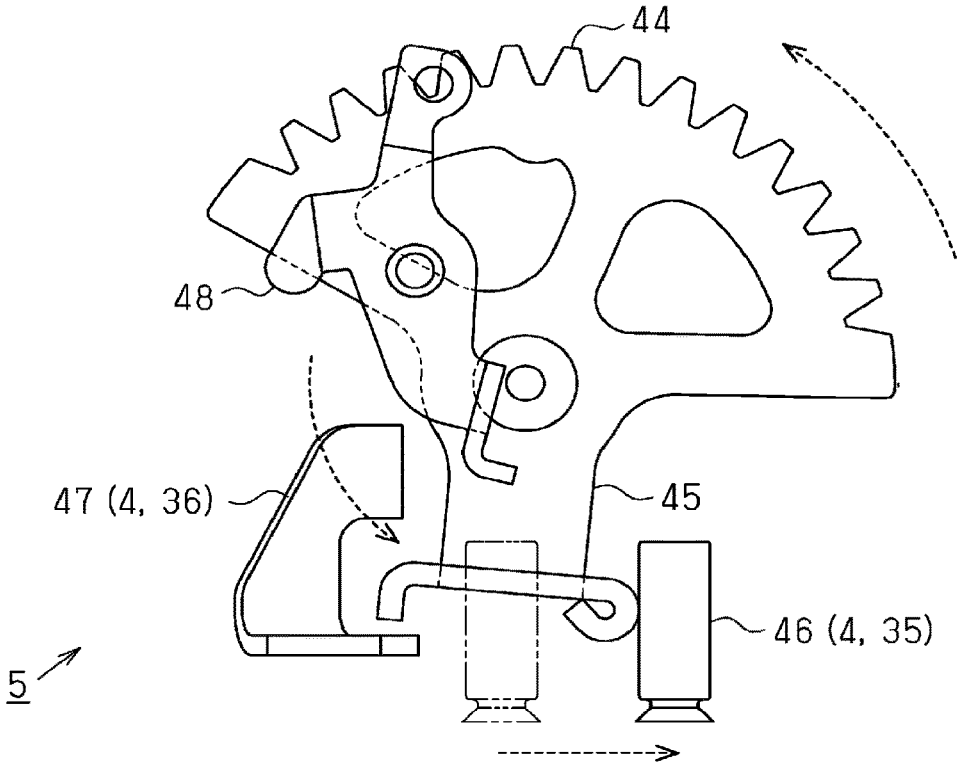
FIG. 11 is a view illustrating an operation of the lock device (when the close operation is performed)
Figure 12:
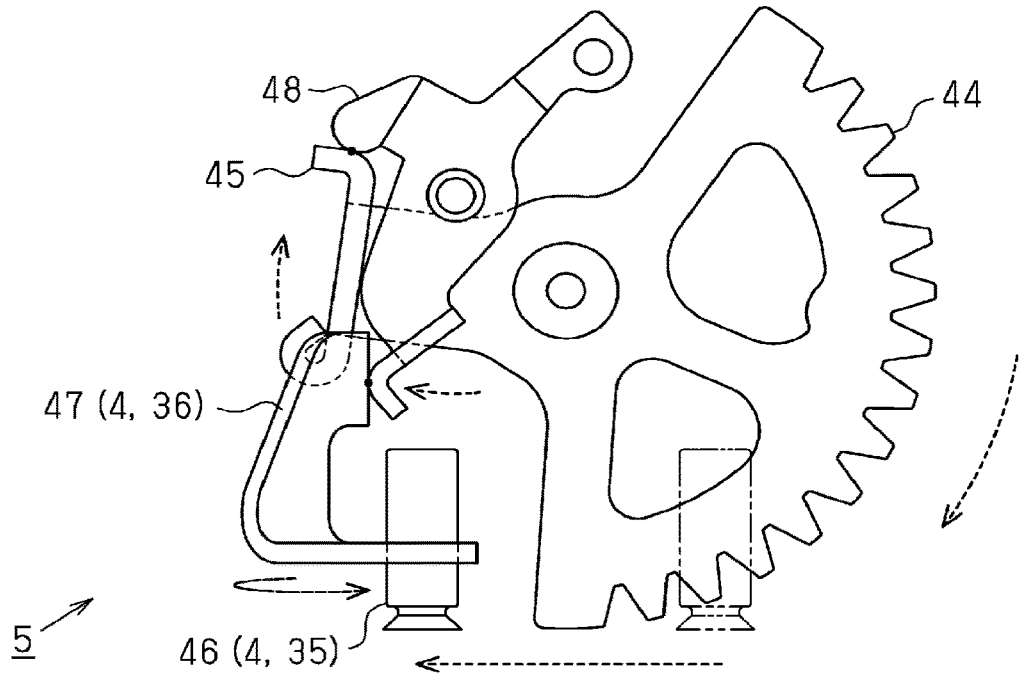
FIG. 12 is a view illustrating an operation of the lock device (when the release operation is performed)

That is, as illustrated in FIGS. 10 to 12, the active lever 45 as a rotation member rotates in a first direction (counterclockwise direction in each drawing) and a second direction (clockwise direction in each drawing) based on the driving force of the lock actuator 41. In addition, the lock device 5 of the embodiment is configured such that when the active lever 45 rotates from a neutral position P0 (see FIG. 10) in the first direction and the active lever 45 rotates to the first position P1, the close operation of the latch mechanism 4 is completed (see FIG. 11). When the active lever 45 rotates from the neutral position P0 in the second direction and the active lever 45 rotates to the second position P2, the release operation of the latch mechanism 4 is completed (see FIG. 12).

Specifically, as illustrated in FIG. 3, the latch mechanism 4 of the embodiment includes a latch level 46 integrally rotating with the latch 35. In addition, as illustrated in FIGS. 10 and 11, the active lever 45 of the embodiment is configured so as to press the latch level 46 by rotating from the neutral position P0 in the first direction. Therefore, the lock device 5 of the embodiment is configured such that the latch mechanism 4 performs the close operation (see FIGS. 6 to 8).

In addition, as illustrated in FIG. 2, the latch mechanism 4 of the embodiment includes a release level 47 integrally rotating with the pawl 36. Furthermore, as illustrated in FIGS. 10 to 12, the active lever 45 of the embodiment is configured so as to press the release level 47 via an open lever 48 by rotating from the neutral position P0 in the second direction. Therefore, the lock device 5 of the embodiment is configured such that the latch mechanism 4 performs the release operation (see FIGS. 8 and 9).

Furthermore, in the lock device 5 of the embodiment, after the close operation and the release operation are completed as described above, the lock actuator 41 is operated and thereby the active lever 45 returns to the neutral position P0. Therefore, it is configured to prepare the next close operation and the release operation. That is, returning of the active lever 45 to the neutral position P0 indicates that the operation of the latch mechanism 4 is initialized.

More specifically, as illustrated in FIG. 1, the door ECU 12 as a control device for controlling the operation of the lock device 25 is connected to a half latch SW 50*a*, a full latch SW 50*b*, and a pawl SW 50*c*, provided in the lock device 5. That is, the door ECU 12 of the embodiment detects operation states of the latch mechanism 4 provided in the lock device 5 specifically, the half latch state, the full latch state, and the release state, based on output signals Swa to Swc of sensor switches 50 (50*a* to 50*c*) respectively. Therefore, it is configured that the operation of the lock actuator 41 provided in the lock device 5 is controlled so that the latch mechanism 4 performs the close operation and the release operation.

In addition, the door ECU 12 of the embodiment measures a duration time T of the neutral return control using a time counter (timer) 51 when executing the neutral return control which causes the active lever 45 rotated in the first direction by the close control and the active lever 45 rotated in the second direction by the release control to reverse operate to return to the neutral position P0. That is, the time counter 51 is configured such that the duration time T indicated by the count value increases, that is, counts up by the duration of the neutral return control executed by the door ECU 12. The door ECU 12 of the embodiment is configured to detect that the active lever 45 returns to the neutral position P0 and to complete the neutral return control based on the duration time T of the neutral return control measured using the time counter 51.

Interruption and Restart Control when Engine Cranking

Next, an interruption and restart control at the time of the engine cranking executed by the door ECU 12 of the embodiment will be described.

As illustrated in FIG. 1, a cranking signal Scr indicating that the cranking of an engine (not illustrated) is performed is input from an engine ECU 52 into the door ECU 12 of the embodiment. The door ECU 12 of the embodiment is configured to interrupt the drive control of the slide door 1 in a case of receiving the cranking signal Scr.

In addition, the door ECU 12 of the embodiment restarts the drive control of the slide door 1 in a case where it is detected that the cranking of the engine is completed due to stop of the cranking signal Scr. It is configured to drive the slide door 1 in the opening and closing operation direction before the interruption of the drive control by restarting the drive control of the interrupted slide door 1.

That is, the power slide door apparatus 20 of the embodiment reserves the opening and closing operation of the slide door 1 under a situation where the supply of the drive power is likely to be unstable based on temporary lowering of the power source voltage Vb caused by the cranking of the engine. After the lowered power source voltage Vb is recovered, the opening and closing drive of the slide door 1 requested by the user is completed.

Furthermore, the door ECU 12 of the embodiment interrupts the operation control thereof even in a case where the operation of the lock device 5 is controlled when receiving the cranking signal Scr. It is configured to restart the operation control of the lock device 5 after the cranking of the engine is completed.

Here, the door ECU 12 of the embodiment holds the duration time T in a storage region 12*a* at the time of interruption in a case where the neutral return control is interrupted during execution of the neutral return control causing the active lever 45 to return to the neutral position P0 after execution of the close control and the release control (held value Tm). It is configured to restart the measurement of the held value Tm of the duration time T held in the storage region 12*a*, that is, the duration time T from a count value at the time of interruption in a case where the neutral return control is restarted by the completion of the cranking.

That is, in the neutral return control in which the active lever 45 rotated in the first direction or the second direction is reversely rotated to return to the neutral position P0, when the interrupted neutral return control is restarted, there is a possibility that the active lever 45 rotates beyond the neutral position P0 by clearing (T=0) the duration time T. However, as described above, it is possible to prevent such an excessive operation of the active lever 45 by restarting the neutral return control from the held value Tm of the duration time T at the time of interruption. Therefore, the power slide door apparatus 20 of the embodiment is configured to secure high reliability.

Figure 13:
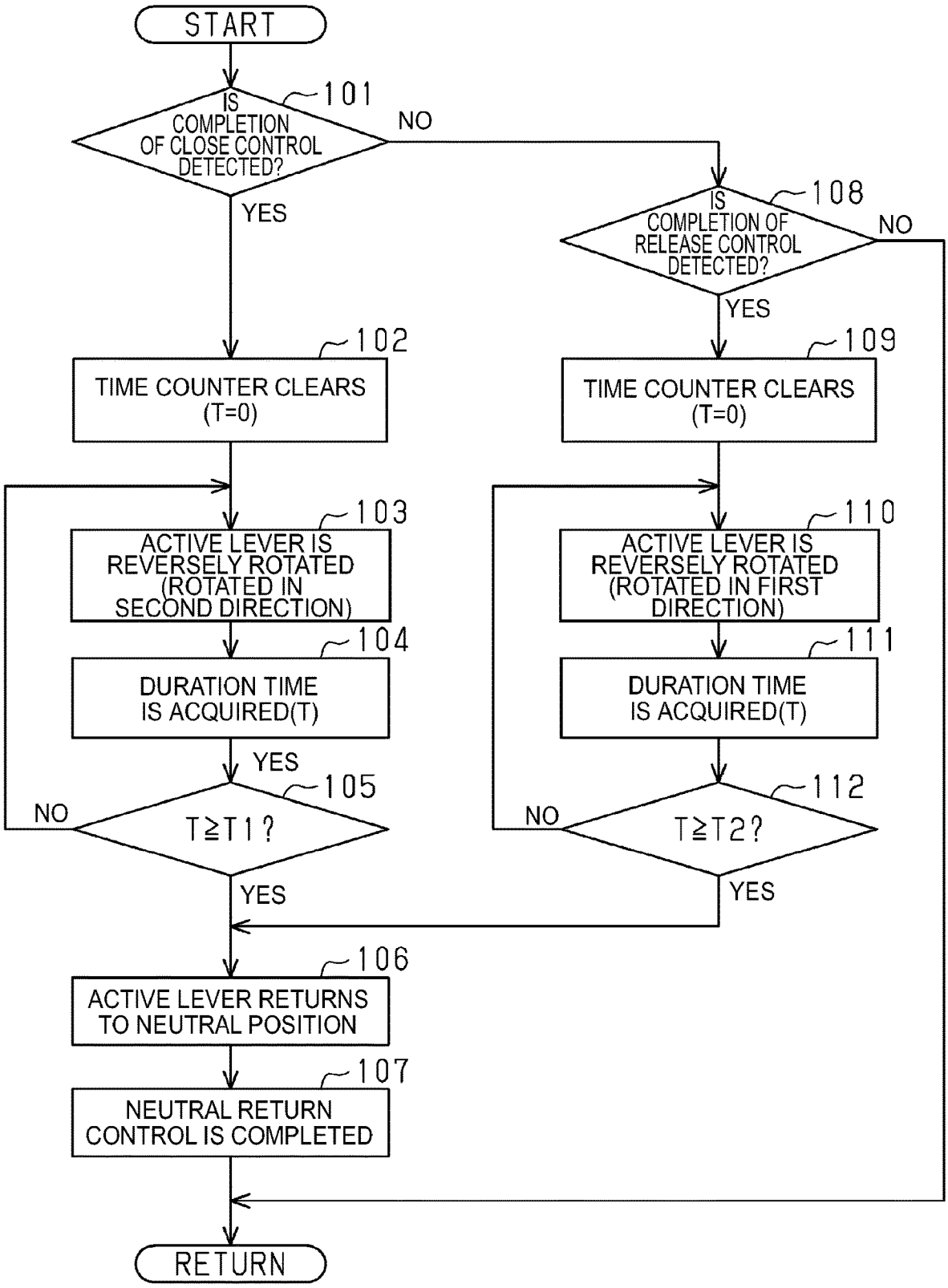
FIG. 13 is a flowchart illustrating a processing procedure of a neutral return control.

More specifically, as illustrated in a flowchart of FIG. 13, the door ECU 12 of the embodiment determines whether or not the close control (see FIG. 11) of the latch mechanism 4 is in the completed state based on each of the output signals Swa to Swc of each of the sensor switches 50 (50*a* to 50*c*) provided in the lock device 5 (step 101). Furthermore, in a case where the completion of the close control is detected in step 101 (step 101: YES), the door ECU 12 substantially clears the time counter 51 (T=0, step 102). The neutral return control is executed by reversely rotating (rotating in the second direction) the active lever 45 so as to return the active lever 45 to the neutral position P0 (step 103).

Next, the door ECU 12 determines whether or not the duration time T reaches a predetermined time T1 by acquiring (step 104) the duration time T of the neutral return control that is the count value of the time counter 51 (step 105). In a case where the duration time T reaches the predetermined time T1 (T≥T1, step 105: YES), it is determined that the active lever 45 returns to the neutral position P0 (step 106) and the neutral return control is completed (step 107).

In addition, in a case where the close control is determined not to be in the completed state in step 101 (step 101: NO), the door ECU 12 of the embodiment sequentially determines whether or not the release control (see FIG. 12) of the latch mechanism 4 is in the completed state, in a case where, in step 101, it is determined that it is not after the completion of the close control (step 108). In step 108, even in a case where the completion of the release control is detected (step 108: YES), the neutral return control is executed by reversely rotating (rotating in the first direction) the active lever 45 so that the time counter 51 is cleared (T=0, step 109) and the active lever 45 returns to the neutral position P0 (step 110).

That is, also in this case, the door ECU 12 of the embodiment determines whether or not the duration time T reaches a predetermined time T2 by acquiring (step 111) the duration time T of the neutral return control that is the count value of the time counter 51 (step 112). In a case where the duration time T reaches the predetermined time T2 (T≥T2, step 112: YES), it is determined that the active lever 45 returns to the neutral position P0 (step 106) and the neutral return control is completed (step 107).

In addition, the door ECU 12 of the embodiment repeats the processes of step 103 and step 104 in a case where, in step 105, the duration time T of the neutral return control executing after the completion of the close control does not reach the predetermined time T1 (T<T1, step 105: NO). In addition, in step 112, even in a case where the duration time T of the neutral return control executing after the completion of the release control does not reach the predetermined time T2 (T<T2, step 112: NO), the processes of step 110 and step 111 are repeated. In step 108, when it is determined that it is not after the completion of the release control (step 108: NO), the processes of step 102 to step 107, and step 109 to step 112 are not executed.

Figure 14:
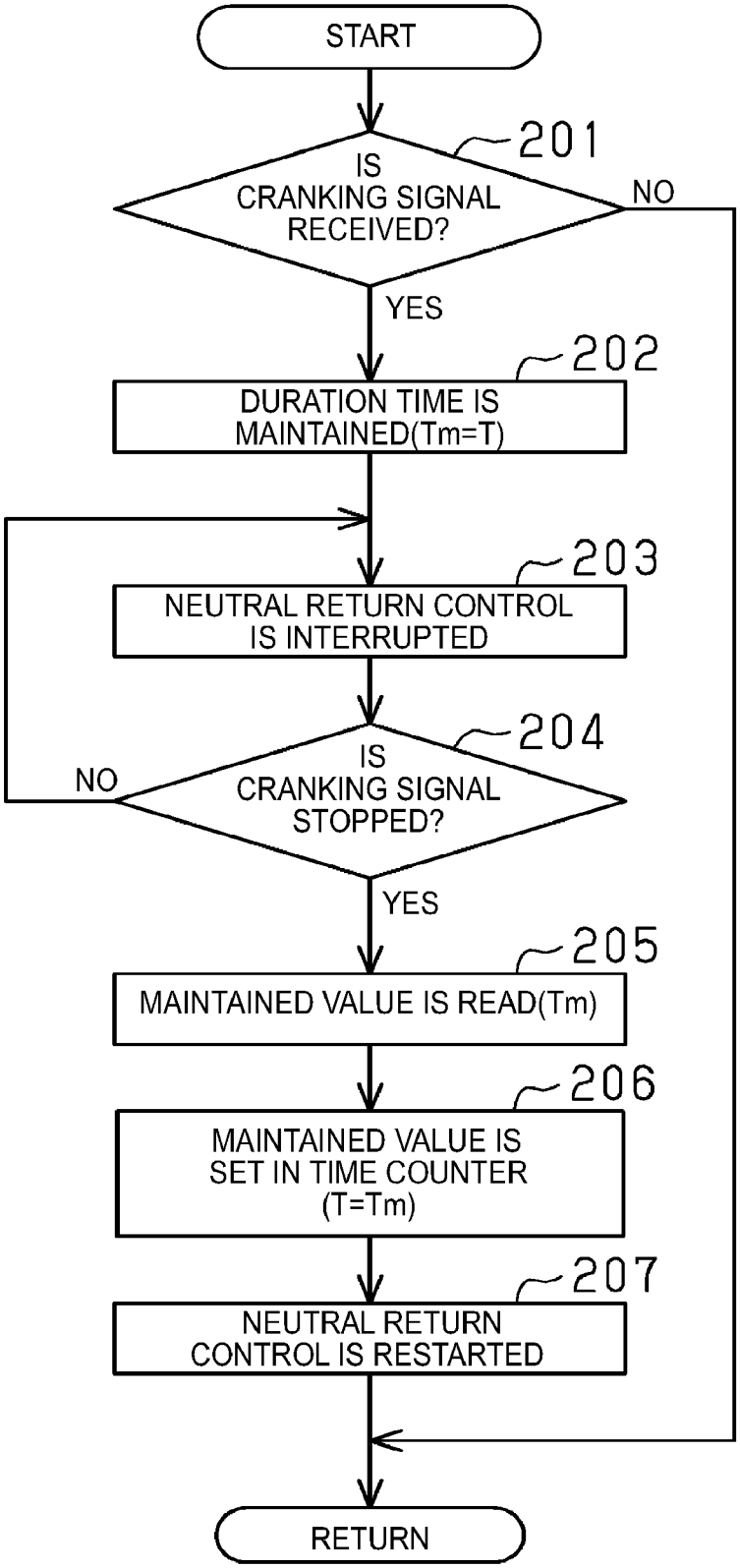
FIG. 14 is a flowchart illustrating a processing procedure of interruption and restart of the neutral return control.

In addition, as illustrated in flowchart in FIG. 14, the door ECU 12 of the embodiment holds the duration time T of the neutral return control in the storage region 12*a* at that time (Tm=T, step 202) and the neutral return control is interrupted (step 203) in a case where the cranking signal Scr is received (step 201: YES) during executing the neutral return control (see FIG. 13). The interruption of the neutral return control is continued until the cranking signal Scr is stopped (step 204: NO).

Furthermore, the door ECU 12 of the embodiment reads the held value Tm of the duration time T stored in step 202 from the storage region 12*a* when it is detected that the cranking of the engine is completed (step 204: YES) by the stop of the cranking signal Scr (step 205). By setting the held value Tm to an initial value of the time counter 51 (T=Tm, step 206), the neutral return control is restarted such a manner as to restart the measurement of the duration time T from the held value Tm of the duration time T at the time of interruption of the neutral return control (step 207).

Above, according to the embodiment, the following effects can be obtained.

(1) The door ECU 12 executes the neutral return control in which the active lever 45 is reversely rotated so that the active lever 45 returns to the neutral position P0. In addition, the door ECU 12 detects that the active lever 45 returns to the neutral position P0 and completes the neutral return control by measuring the duration time T of the neutral return control based on the duration time T, by using the time counter 51. Furthermore, the door ECU 12 holds the duration time T (held value Tm) in the storage region 12*a* at the time of interruption in a case where the neutral return control is interrupted. In a case where the neutral return control is restarted, the measurement of the duration time T is restarted from the held value Tm.

According to the configuration, even when restarting the interrupted neutral return control, it is possible to prevent occurrence of excessive operation such as the active lever 45 rotates in the second direction beyond the neutral position P0 and the lock device 5 can correctly function. Therefore, it is possible to secure high reliability.

(2) Particularly, in a case where the neutral return control is interrupted after the close control is completed, it is possible to prevent the release operation of the latch mechanism 4 generated as the active lever 45 rotates in the second direction beyond the neutral position P0 by restarting the measurement of the duration time T at the time of restart from the held value Tm at the time of interruption. Therefore, it is possible to secure high safety.

(3) The door ECU 12 interrupts the operation control of the lock device 5 by starting the cranking of the engine and restarts the operation control of the lock device 5 by completing the cranking.

That is, during the cranking of the engine, the starter (not illustrated) consumes a large amount of power so that the power source voltage Vb of the vehicle-mounted power source 13 is temporarily lowered. According to the configuration, it is possible to prevent the operation control of the lock device 5, which includes the neutral return control, from being performed under the situation where the supply of the drive power is likely to be unstable and the power source voltage Vb is lowered. Therefore, a high texture can be secured. In addition, particularly, in a compact car or the like having a small capacity of the vehicle-mounted power source 13, it is possible to promptly start the engine by concentrating the output of the vehicle-mounted power source 13 to the starter. Therefore, it is possible to prevent overdischarging of the vehicle-mounted power source by suppressing power consumption.

Moreover, the embodiment may be changed as follows.

In the embodiment, the slide door 1 provided on the side surface of the vehicle is embodied in the power slide door apparatus 20 and the lock device 5 causing the slide door 1 to perform the opening and closing operation. However, the disclosure is not limited thereto and may be applied to another power door apparatus such as a swing type door, a rear door and a luggage door provided at a rear portion of a vehicle. The disclosure may be applied to an opening and closing body control apparatus for a vehicle intended for an opening and closing body such as a sunroof apparatus or a power window apparatus other than the door.

The number and arrangement of the lock devices 5 provided in the slide door 1 may be arbitrary changed.

In the embodiment, the lock device 5 includes the active lever 45 rotated in the first direction and the second direction by the drive of the motor. The latch mechanism 4 performs the close operation and the release operation according to the rotating direction of the active lever 45. However, the disclosure is not limited thereto and the configuration of the rotation member, which causes the latch mechanism 4 to perform the close operation and the release operation by being rotated in the first direction and the second direction, may be arbitrary changed.

As the time counter (timer) 51 for measuring the duration time T of the neutral return control, one that counts up every calculation cycle may be used, or a free run counter may be used. That is, when restarting the interrupted neutral return control, it suffices if it is possible to restart the measurement of the duration time T from the held value Tm at the time of interruption.

In addition, the count value of the counter may not necessarily coincide with the duration time T of the neutral return control as long as the neutral return control is continued and thereby the neutral return of the active lever 45 configuring the rotation member is determined based on the count value of the counter performing the count-up. Specifically, a counter counting up in synchronization with the rotation of the motor 40 that is the drive source is used. That is, a pulse sensor is provided in the motor 40, the speed reducer 42 of the lock actuator 41, or the like. It may be applied to a configuration in which the counter counts up by detecting an output signal (rising or falling thereof) of the pulse sensor.

Figure 15:
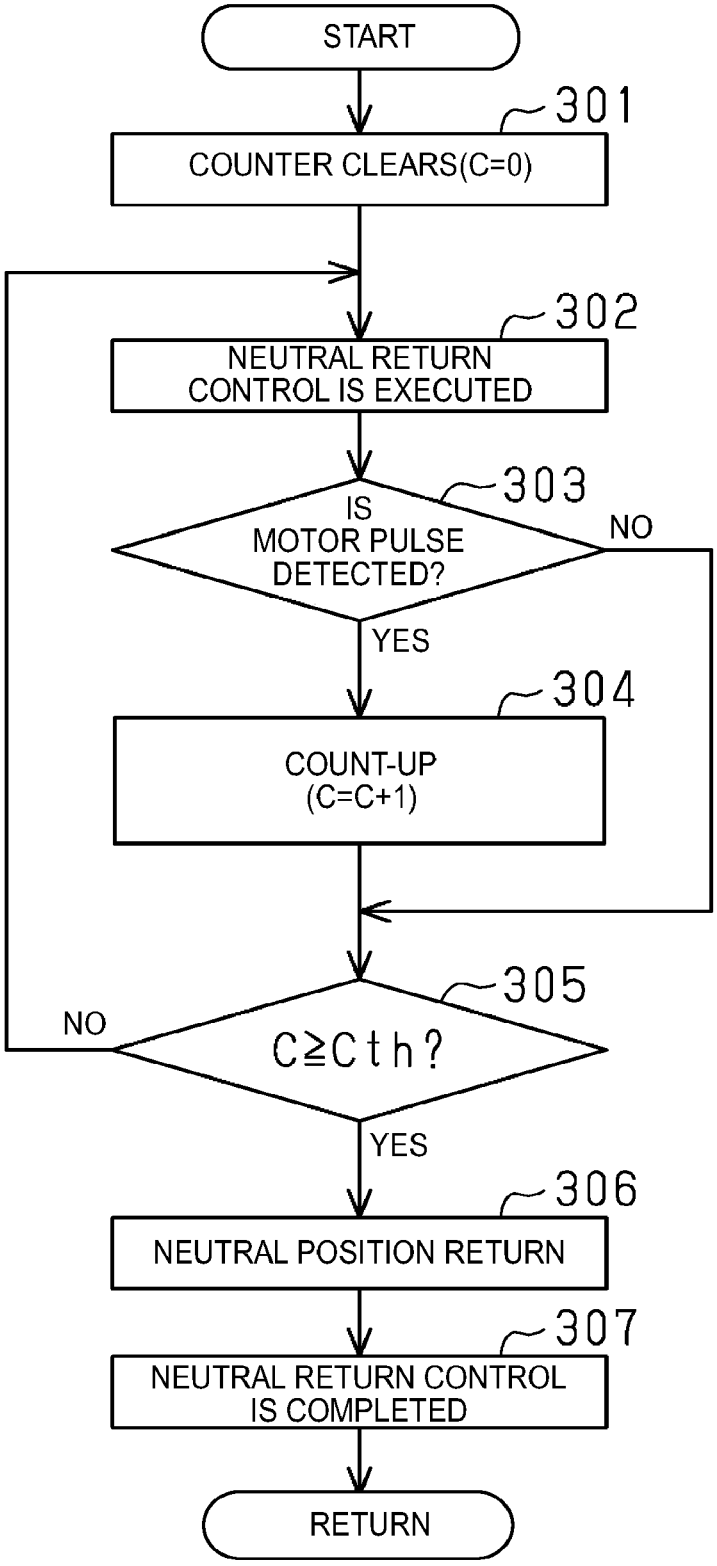
FIG. 15 is a flowchart illustrating a processing procedure of a neutral return control of another example.

For example, as illustrated in a flowchart of FIG. 15, the door ECU 12 clears a count value C of the counter (C=0, step 301) and when starting the execution of the neutral return control (step 302), first, it is determined whether or not a motor pulse indicating the rotation of the motor 40 that is the drive source is detected (step 303). In a case where the motor pulse is detected (step 303: YES), that is, in a case where it is detected that the motor 40 is rotated (for example, one rotation) by the continuation of the neutral return control, the counter counts up (C=C+1, step 304).

Next, the door ECU 12 determines whether or not the count value C of the counter reaches a predetermined threshold value Cth (step 305). In addition, a value of the threshold value Cth may be changed between at the time of the neutral return control after the completion of the close control and at the time of the neutral return control after the completion of the release control. In a case where the count value C reaches the predetermined threshold value Cth (C≥Cth, step 305: YES), it is determined that the active lever 45 returns to the neutral position P0 (step 306) and the neutral return control may be completed (step 307).

That is, in this case, the count value C indicates a reverse rotation amount of the active lever 45 according to the rotation of the motor 40. Therefore, as illustrated in the example, it is possible to perform the neutral return determination for determining whether the active lever 45 returns to the neutral position based on the count value C.

Furthermore, also in this case, when the neutral return control is interrupted, the count value C at the time of interruption is held. When restarting the neutral return control, also in the neutral return control executed after the completion of the release control, it is possible to prevent occurrence of an excessive operation such as the active lever 45 rotates beyond the neutral position P0 and thereby the lock device 5 can correctly function by restarting the count-up of the counter from the holding value at the time of interruption.

In the embodiment, the drive control of the slide door 1 and the operation control of the lock device 5 are interrupted when starting cranking under a situation where the power source voltage Vb is likely to be lowered, the cranking is completed in which the power source voltage Vb is supposed to recover, and then the drive control of the slide door 1 and the operation control of the lock device 5 which are interrupted are restarted. However, the disclosure is not limited thereto, and by directly monitoring (detecting) the power source voltage Vb of the vehicle-mounted power source 13, the drive control of the slide door 1 and the operation control of the lock device 5 are interrupted, and the drive control of the stopped slide door 1 and the operation control of the lock device 5 whether interrupted may be restarted.

Figure 16:
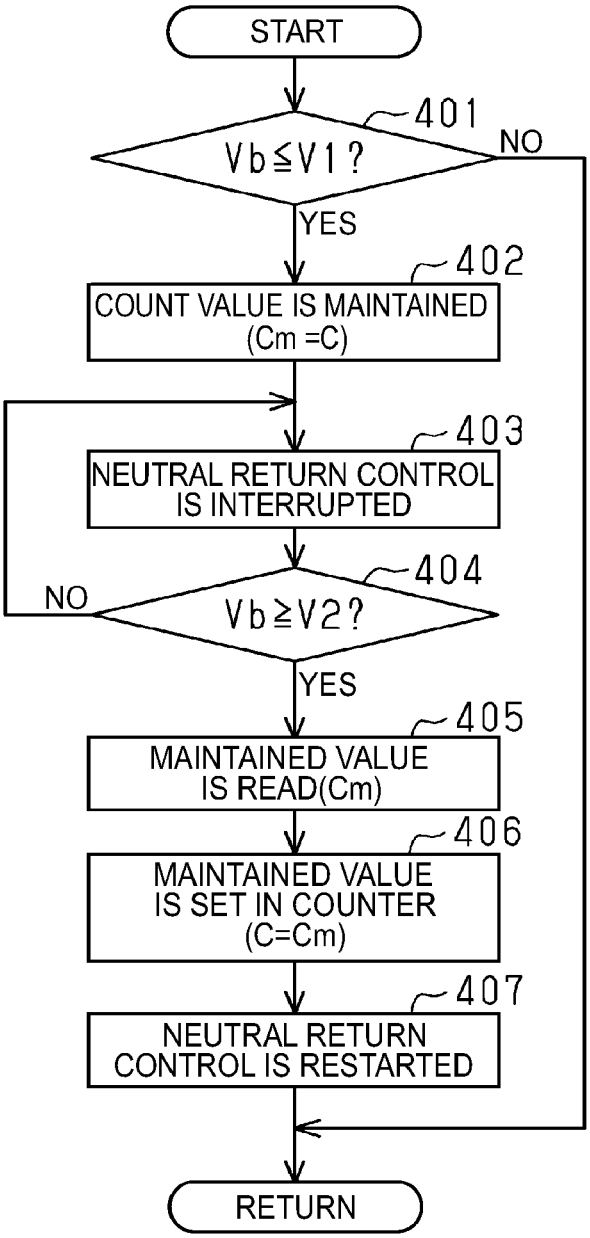
FIG. 16 is a flowchart illustrating another processing procedure of interruption and restart of the neutral return control.

For example, as illustrated in a flowchart of FIG. 16, during execution of the neutral return control (for example, see FIG. 15), the door ECU 12 determines whether or not the power source voltage Vb of the vehicle-mounted power source 13 is a first threshold V1 or less (step 401). In a case where the power source voltage Vb is the first threshold V1 or less (Vb≤V1, step 401: YES), the count value C of the counter at that time is held in the storage region 12*a* (Cm=C, step 402) and the neutral return control is interrupted (step 403).

In addition, in a case where the neutral return control is interrupted, the door ECU 12 determines whether or not the power source voltage Vb is a second threshold V2 or more (step 404) and in a case where the power source voltage Vb is the second threshold V2 or more (Vb≥V2, step 404: YES), the door ECU 12 reads a held value Cm stored in the storage region 12*a* (step 405). By setting the held value Cm as an initial value of the counter (C=Cm, step 406), the neutral return control is restarted in a manner of restarting the count-up of the counter from the held value Cm, that is, the count value C at the time of interruption of the neutral return control (step 407).

That is, also in this case, the interruption of the neutral return control (lock operation control including the neutral return control) is continued as long as the power source voltage Vb of the vehicle-mounted power source 13 is lower than the second threshold V2 (Vb<V2, step 404: NO). The second threshold V2 in the restart determination of step 403 is set higher than the first threshold V1 in the interruption determination of step 401 (V2>V1). Therefore, the interruption determination and the restart determination can be stably performed.

In addition, it may be configured to interrupt and restart the drive control of the slide door 1 and the operation control of the lock device 5 based on an event other than the cranking that may cause the power source voltage Vb of the vehicle-mounted power source 13 to be lowered.

Figure 17:
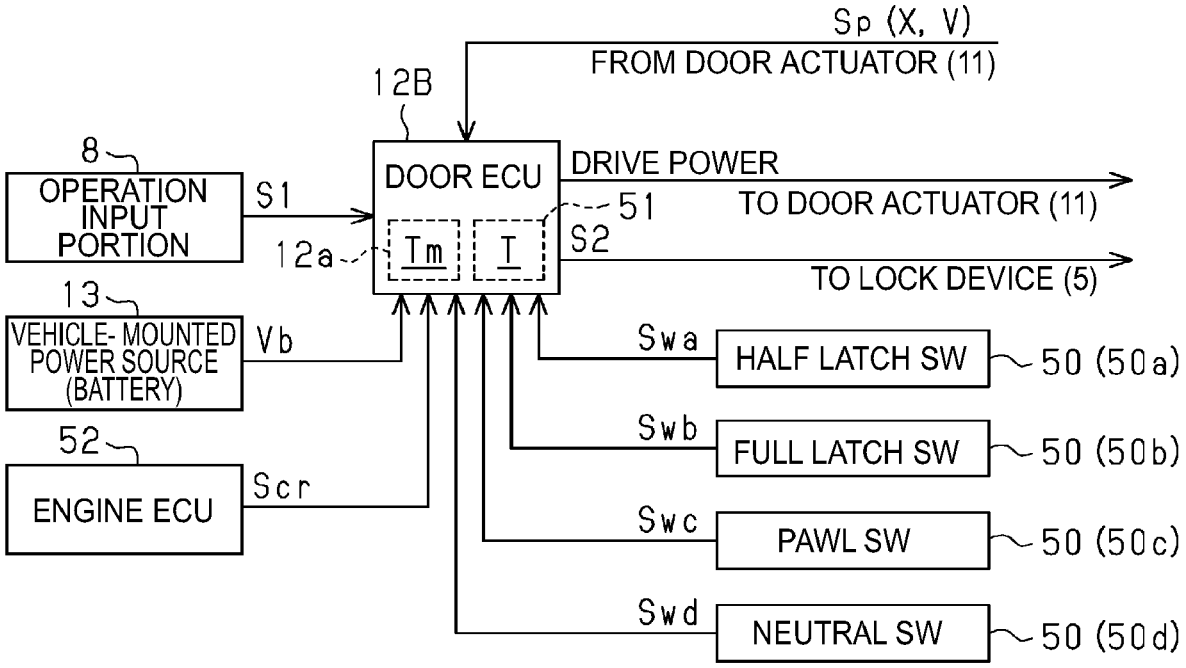
FIG. 17 is a view illustrating a schematic configuration of a power slide door apparatus of another example.

As illustrated in FIG. 17, the disclosure may be applied to a configuration in which a neutral SW 50*d* as the sensor switch 50 for detecting the neutral position P0 of the active lever 45 is connected to a door ECU 12B. That is, the door ECU 12B detects a neutral return of the active lever 45 based on an output signal Swd of the neutral SW 50*d*. Regarding such a configuration, a configuration, in which the execution of the neutral return determination using the counter illustrated in the embodiment and the other example and the completion of the neutral return control based on the result of the neutral return determination are utilized together, may be applied.

That is, it is possible to prevent the occurrence of the excessive operation such as the active lever 45 rotates beyond the neutral position P0 and the lock device 5 can correctly function by employing such a configuration even in a case where failure occurs in the neutral SW 50*d*. Therefore, it is possible to secure high reliability.

Figure 18:
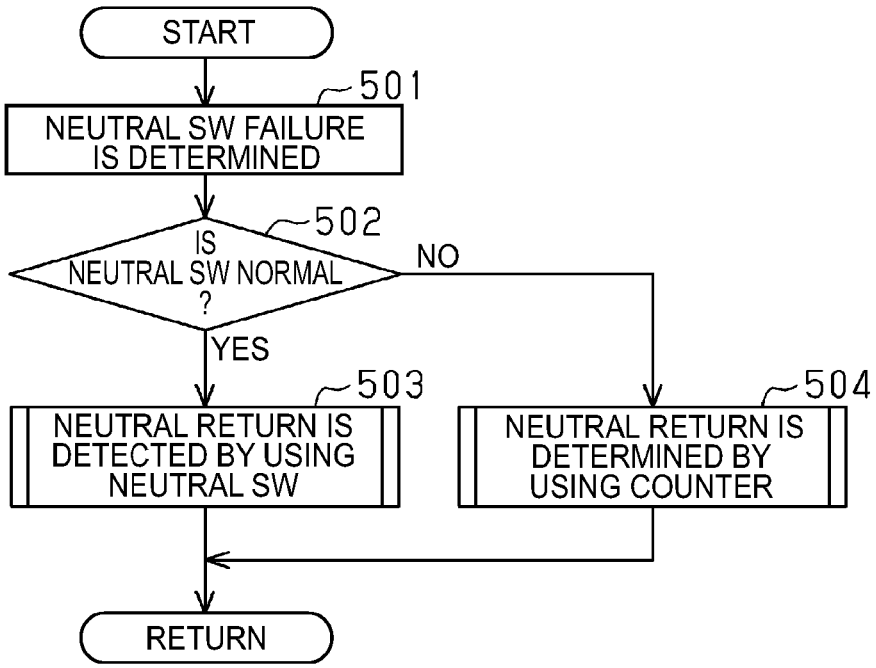
FIG. 18 is a flowchart illustrating a processing procedure relating to a failure determination of a sensor switch and switching between the neutral return detection and the neutral return determination based on a determination result.

In addition, as illustrated in a flowchart of FIG. 18, a failure determination of the neutral SW 50*d* is executed (step 501) and in a case where the neutral SW 50*d* is normal (step 502: YES), the neutral return detection is executed based on the output signal Swd of the neutral SW 50*d* (step 503). In a case where a failure occurs in the neutral SW 50*d* (step 502: NO), the neutral return determination may be executed by using the counter described above (step 504).

In the embodiment and another example, the door ECU 12 as the control device controls the operation of the lock device 5. The door ECU 12 has functions as the neutral return control portion, the counter, the neutral return determination portion, the counter holding portion, the interruption control portion, the restart control portion, the neutral return detection portion, and the failure detection portion. However, the disclosure is not limited thereto and a configuration, in which such a control device is formed in a distributed manner in a plurality of information processing devices, may be provided. Each of function control portions may also be distributed among these information processing devices.

Next, technical ideas which can be grasped from the embodiments will be described together with effects.

It is preferable that an opening and closing body control apparatus for a vehicle according to an aspect of this disclosure includes a lock device that has a latch mechanism; and a control device that controls an operation of the lock device, in which the lock device has a rotation member rotating in a first direction and a second direction, and the latch mechanism performs a close operation and a release operation according to a rotating direction of the rotation member, the control device executes a close control for rotating the rotation member from a neutral position to a first position in the first direction in order to cause the latch mechanism to perform the close operation, the control device includes a neutral return control portion rotating the rotation member so as to return the rotation member to the neutral position after completion of the close control, the neutral return control portion includes a counter that counts up by continuing the neutral return control for returning the rotation member to the neutral position, a neutral return determination portion that determines whether the rotation member returns to the neutral position, based on a count value of the counter, and a count holding portion that holds the count value at the time of interruption in a case where the neutral return control is interrupted, and in a case where the neutral return control is restarted, the count-up of the counter is restarted from the count value at the time of interruption.

According to this configuration, even at the restarting of the interrupted neutral return control, it is possible to prevent occurrence of an excessive operation such as the rotation member rotating beyond the neutral position, and thereby the lock device can correctly function. Therefore, it is possible to ensure high reliability.

Particularly, in a case where the neutral return control is interrupted after the close control is completed, the count-up of the counter at the time of restart of the neutral return control is restarted from a holding value at the time of interruption. Therefore, it is possible to prevent the release operation of the latch mechanism caused by the rotation member rotating in the second direction beyond the neutral position. Therefore, it is possible to secure high safety.

In the opening and closing body control apparatus for a vehicle according to the aspect of this disclosure, it is preferable that the counter is a time counter that measures a duration time of the neutral return control.

According to this configuration, it is possible to appropriately determine the neutral position return of the rotation member with a simple configuration. It is possible to secure high reliability by a combination with the configuration in which the count-up of the counter is restarted from the count value at the time of interruption as described above.

In the opening and closing body control apparatus for a vehicle according to the aspect of this disclosure, it is preferable that the lock device receives a supply of drive power for driving the lock device by a power source voltage of the vehicle-mounted power source, and the control device includes an interruption control portion that interrupts an operation control of the lock device when the power source voltage is lowered, and a restart control portion that restarts the operation control of the lock device in a case where the power source voltage is recovered.

According to this configuration, it is possible to prevent an operation control of the lock device from being performed under a situation where the supply of the drive power is likely to be unstable and the power source voltage is lowered. Therefore, a high texture can be secured.

In the opening and closing body control apparatus for a vehicle according to the aspect of this disclosure, it is preferable that the interruption control portion interrupts the operation control of the lock device when cranking of an engine is started, and the restart control portion restarts the operation control of the lock device when the cranking is completed.

That is, during cranking of the engine, a starter consumes a large amount of power so that the power source voltage of the vehicle-mounted power source is temporarily lowered. Therefore, according to the configuration, it is possible to prevent the operation control of the lock device from being performed under a situation where the supply of the drive power is likely to be unstable and the power source voltage is lowered. In addition, particularly, in a compact car or the like having a small capacity of the vehicle-mounted power source, it is possible to promptly start the engine by concentrating the output of the vehicle-mounted power source to the starter. Therefore, it is possible to prevent overdischarging of the vehicle-mounted power source by suppressing power consumption.

In the opening and closing body control apparatus for a vehicle according to the aspect of this disclosure, it is preferable that the control device executes a release control for rotating the rotation member from the neutral position to a second position in a second direction in order to cause the latch mechanism to perform the release operation, the neutral return control portion executes a neutral return determination of the rotation member based on the count value even in the neutral return control executed after the completion of the release control, and the count-up of the counter is restarted from the count value at the time of interruption even in a case where the neutral return control is restarted after the interruption of the neutral return control.

According to this configuration, also in the neutral return control executed after the completion of the release control, it is possible to prevent occurrence of an excessive operation such as the rotation member rotating beyond the neutral position and thereby the lock device can correctly function. Therefore, it is possible to ensure high reliability.

In the opening and closing body control apparatus for a vehicle according to the aspect of this disclosure, it is preferable that the neutral return control portion includes a neutral return detection portion that detects a neutral return of the rotation member based on an output signal of a sensor switch for detecting a neutral position of the rotation member, and a failure detection portion that detects a failure of the sensor switch, and in a case where the failure of the sensor switch is detected, the neutral return control is completed based on a result of the neutral return determination using the counter.

According to this configuration, even in a case where a failure occurs in the sensor switch, it is possible to prevent the occurrence of the excessive operation such as the rotation member rotating beyond the neutral position and the lock device can correctly function. Therefore, it is possible to secure high reliability.

According to the aspect of this disclosure, even in a case where the neutral return control is interrupted, the lock device can correctly function after restart of the neutral return control.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An opening and closing body control apparatus for a vehicle, comprising:

a lock device that includes an actuator that rotates a rotation member in a first direction and a second direction based on the output of the actuator;

a latch mechanism that includes a latch configured to perform a close operation and a release operation based on the rotation of the rotation member, the close operation moving the latch to a full latch state and the release operation moving the latch to an unlock state; and a control device that controls an operation of the actuator of the lock device, wherein the control device executes a close control to rotate the rotation member in the first direction from a neutral position to a first position to perform the close operation, the control device includes a neutral return control portion to rotate the rotation member in the second direction to return the rotation member to the neutral position after completion of the close control, the neutral return control portion includes a counter that counts up by continuing the neutral return control for returning the rotation member to the neutral position, a neutral return determination portion that determines whether the rotation member returns to the neutral position, based on a count value of the counter, and a count holding portion that holds the count value at a time of interruption in a case where the neutral return control is interrupted, and in a case where the neutral return control is restarted after being interrupted, the count-up of the counter is restarted from the count value at the time of interruption.

2. The opening and closing body control apparatus for a vehicle according to claim 1, wherein the counter is a time counter that measures a duration time of the neutral return control.

3. The opening and closing body control apparatus for a vehicle according to claim 1, wherein the actuator receives a supply of drive power for driving the lock device by a power source voltage of the vehicle-mounted power source, and the control device includes an interruption control portion that interrupts an operation control of the lock device when the power source voltage is lowered, and a restart control portion that restarts the operation control of the lock device in a case where the power source voltage is recovered.

4. The opening and closing body control apparatus for a vehicle according to claim 3, wherein the interruption control portion interrupts the operation control of the lock device when cranking of an engine is started, and the restart control portion restarts the operation control of the lock device when the cranking is completed.

5. The opening and closing body control apparatus for a vehicle according to claim 1, wherein the control device executes a release control to rotate the rotation member in the second direction from the neutral position to a second position to perform the release operation, the neutral return control portion executes a neutral return determination of the rotation member based on the count value even in the neutral return control executed after the completion of the release control, and the count-up of the counter is restarted from the count value at the time of interruption even in a case where the neutral return control is restarted after the interruption of the neutral return control.

6. The opening and closing body control apparatus for a vehicle according to claim 1, wherein the neutral return control portion includes a neutral return detection portion that detects a neutral return of the rotation member based on an output signal of a sensor switch for detecting a neutral position of the rotation member, and a failure detection portion that detects a failure of the sensor switch, and in a case where the failure of the sensor switch is detected, the neutral return control is completed based on a result of the neutral return determination using the counter.

* * * * *